US006573663B1

(12) United States Patent
MacGregor et al.

(10) Patent No.: US 6,573,663 B1
(45) Date of Patent: Jun. 3, 2003

(54) HIGH INTENSITY LIGHT SOURCES

(75) Inventors: Scott John MacGregor, Cambuslang (GB); Richard Anthony Fouracre, Gargunnock (GB)

(73) Assignee: University of Strathyclyde, Glasgow (GB)

( * ) Notice: Subject to any disclaimer, the term of this patent is extended or adjusted under 35 U.S.C. 154(b) by 0 days.

(21) Appl. No.: 09/269,124

(22) PCT Filed: Sep. 19, 1997

(86) PCT No.: PCT/GB97/02539

§ 371 (c)(1),
(2), (4) Date: May 13, 1999

(87) PCT Pub. No.: WO98/12735

PCT Pub. Date: Mar. 26, 1998

(30) Foreign Application Priority Data

Sep. 20, 1996 (GB) ..... 9619681

(51) Int. Cl.[7] ..... H05B 41/24; H05B 39/00
(52) U.S. Cl. ..... 315/246; 315/160; 361/225
(58) Field of Search ..... 315/160, 246; 250/552; 362/84, 85; 361/225, 229

(56) References Cited

U.S. PATENT DOCUMENTS 3,963,488 A * 6/1976 Brushenko ..... 361/225
5,118,989 A 6/1992 Egermeier et al. ..... 313/631

FOREIGN PATENT DOCUMENTS

JP 60 134252 11/1985

OTHER PUBLICATIONS

Zhu Fang et al., *Investigations of Surface Charging of DC Insulator Spacers*, IEEE 1995 Annual Report, Conference on Electrical Insulation and Dielectric Phenomena (Cat. No. 95CH35842), Proceedings of 1995 Conference on Electrical Insulation and Dielectric Phenomena, Virginia Beach, VA, Oct. 22–25, 1995, ISBN 0–7803–2931–7, 1995, New York, NY, IEEE, USA, pp. 428–431.

* cited by examiner

*Primary Examiner*—Don Wong
*Assistant Examiner*—Thuy Vinh Tran
(74) *Attorney, Agent, or Firm*—Alston & Bird LLP

(57) ABSTRACT

A high intensity light source comprises a solid dielectric sheet having its back surface in contact with a conducting medium, which is electrically conducted to a fixed potential (such as ground) and its front surface free to receive electric charge to be electrostatically bound to the sheet. In one example, the charge is delivered to the surface by a unipolar Corona discharge arrangement having a plurality of Corona sources at different locations over the surface of the sheet. In order to generate a light output from the source, the electric charge build-up on the surface is discharged as an electric discharge by the rapid application of a switchable voltage to at least a localized region of the surface.

10 Claims, 2 Drawing Sheets

HIGH INTENSITY LIGHT SOURCES

BACKGROUND OF THE INVENTION

1. Field of Invention

The present invention relates to high intensity light sources and in particular to high intensity light sources which utilise an electric discharge to generate light.

2. Description of Related Art

There are many applications in which high intensity light sources are required. For example, as optical pumps for lasers, e.g. dye lasers, UV light sources in for example UV sterilisation and UV polymer curing, and in the generation of ozone for sterilisation, bleaching etc.

BRIEF SUMMARY OF THE INVENTION

It is an object of the present invention to provide a new and improved form of high intensity light source which utilises an electric discharge to generate light.

According to a first aspect of a present invention there is provided a high intensity light source comprising:

a solid dielectric sheet having a front and a back surface;

a conducting medium in contact with at least a portion of said back surface of the dielectric sheet, said conducting medium being electrically connected in use to a fixed potential;

means for establishing electric charge of a first polarity which is electrostatically bound to said front surface of the dielectric sheet at a potential which is different to said fixed potential; and selectively-operable means coupled to said front surface of the dielectric sheet for applying a rapid potential change to at least a localised region of said front surface so as to cause the charge built-up on the dielectric sheet to form an electric discharge with the consequential emission of light.

Preferably the means for generating the electrical discharge rapidly applies a voltage to the front surface of the dielectric sheet which voltage is of a polarity opposite to said first polarity. However, it is to be noted that polarity reversal it not essential.

The means for rapidly applying the voltage change to the dielectric sheet may be application of ground (earth) potential or it may be a pulse generating means. The electrical pulse generating means may comprise a high voltage pulse generator coupled to the front surface of the dielectric sheet by an electrical conductor. Typically, the pulse generating means is arranged to generate a pulse having a voltage of between 5 V and 30 KV, for example approximately 20 KV. Alternatively however, the pulse generating means may be a step voltage generator or an impulse voltage generator.

The means for establishing the electrical charge may comprise a thermionic emitter, a field emitter, an electron beam or an ion beam generator or a Corona discharge generator.

The dielectric sheet may be sufficiently thin as to be flexible or may be relatively thick and rigid and may be made of, for example, nylon, polyester, polyethylene, PTFE, PVC, rubber, glass, quartz, ceramics or oil-impregnated paper. The dielectric sheet may also be such that said electrical discharge is wholly or partially located within the dielectric sheet, close to the front surface. The dielectric sheet may be photoconductive to achieve a more rapid discharge due to the increase in conductivity when discharge occurs.

Said conducting medium is preferably a solid conducting medium evaporated, adhered to, or otherwise contacting said back surface of the dielectric sheet. The conducting medium may be a metal, a semiconductor, a photoconductor, or a conducting polymer. When the conducting medium is a photoconductor it may be possible actively and transiently to write a conducting pattern onto the conducting medium, e.g. using a laser, to control the path of the electrical discharge. The solid conducting medium may have any appropriate shape. For example, the conducting medium may comprise one or more wires or tracks arranged in parallel, in spokes, or in a spiral.

Alternatively, the conducting medium may be a conducting plasma exposed to the back surface of the dielectric sheet.

The dielectric sheet and the conducting medium of the high intensity light source may be contained within a sealed housing within which said electrical discharge is generated. The housing may be evacuated or may contain a gas such as air, neon, xenon, argon, helium, mercury vapour, carbon dioxide, $SF_6$ or any combination of these whereby by appropriate selection of the atmosphere the emission spectrum of the light source may be varied or tuned through the range covering infra-red, visible and ultraviolet.

Preferably, said charge is built-up on the front surface of the dielectric sheet by exposure to an electrical discharge. Preferably, a unipolar Corona discharge. The means for generating the Corona discharge may comprise a multiplicity of Corona electrode points or wires disposed in front of the front surface of the dielectric sheet. The Corona voltage may be in the range of 20 v to 50 KV, for example approximately 40 KV.

The dielectric sheet may have any suitable shape and, if flexible, it may be reconfigurable. For example, the dielectric sheet may be substantially planar. Alternatively, the sheet may be cylindrical, part-spherical, conical, or parabolic. It will be appreciated that, providing that the surface exposed to the electrical discharge is on the inner surface of the dielectric sheet, these arrangements can be used to concentrate light in a particular direction.

By virtue of the present invention, which utilises only a small amount of energy to initiate the discharge and a separate mechanism for building up and storing charge on the dielectric sheet, the conversion efficiency of the light source is high and the discharge path length need not be curtailed. Furthermore in particular embodiments the emission spectrum is tunable and if the dielectric sheet is flexible the source may be geometrically reconfigured to direct the light emission in a preferred direction. The source can be made relatively small and portable whilst delivering high intensity light to a closely-coupled target.

According to a second aspect of the present invention there is provided a method of generating light pulses using a light source comprising a dielectric having a front and a back surface and a conducting medium in contact with at least a portion of said back surface of the dielectric sheet, the method comprising the steps of:

applying a fixed electrical potential to said conducting medium;

causing a build up of charge to occur on the front surface of the dielectric sheet; and subsequently applying an electrical voltage pulse to the front surface of the dielectric sheet to discharge the built-up charge.

BRIEF DESCRIPTION OF THE SEVERAL VIEWS OF THE DRAWING(S)

For a better understanding of the present invention and in order to show how the same may be carried into effect reference will now be made, by way of example, to the accompanying drawings, in which.

DETAILED DESCRIPTION OF THE INVENTION

Figure 1:
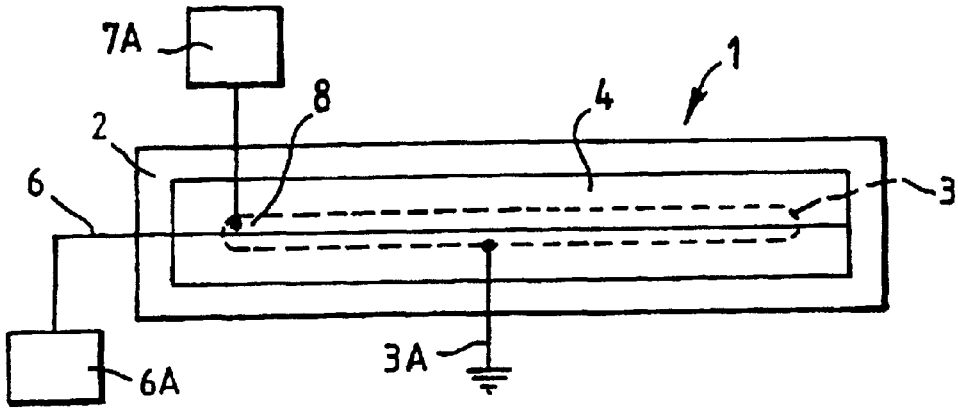
FIG. 1 is a schematic plan view (not to scale) of a high intensity light source embodying the present invention.
Figure 2:
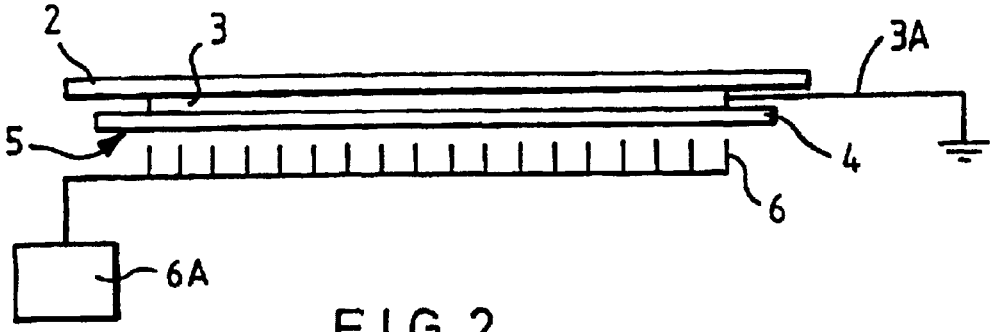
FIG. 2 is a front view of the light source of FIG. 1.
Figure 3:
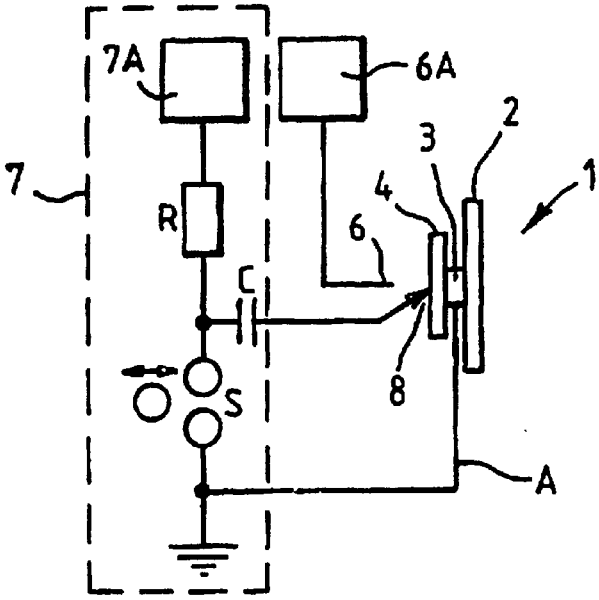
FIG. 3 shows a side view of the light source of FIG. 1 illustrating the electrical circuitry in more detail.

There is illustrated schematically in FIGS. 1, 2 and 3 a high intensity light source 1 which utilises an electric discharge to generate light. The light source 1 comprises an insulating support 2 which is a generally rectangular plate. Covering a central region of the insulating support 2 and secured thereto, is a length of metallic screening tape 3 (i.e. the tape 3 is electrically conductive) having adhesive on both sides. The screening tape is approximately 5 cm wide and 4 m long and is electrically connected to a fixed electrical potential such as earth, as shown at 3A. Secured to the other surface of the metallic tape 3 is a solid dielectric sheet in the form of a length of polyester (type 226) film 4 having a length of slightly more than 4 m, a width of 30 cm, and a thickness of 350 $\mu$m. Disposed in front of the exposed or front surface 5 of the polyester film 4 are a plurality of Corona sources 6. Each of these sources 6 is a non-uniform field electrode. The sources 6 are placed at 10 cm intervals along the length of the polyester film 4 and are connected in parallel to a high voltage +40 KV DC supply 6A. Each of the electrodes 6 generates a Corona discharge at its tip which results in the formation of a space charge.

The metallic tape 3 is connected to earth by lead 3A and the adhesive on the tape is preferably electro conductive so that when the Corona electrodes 6 are activated by virtue of DC supply 6A being switched on, the resulting space charge tends to drift towards the front surface 5 of the polyester film 4 under the action of the applied field between the Corona electrodes 6 and the earthed metallic tape 3. This results in the surface 5 of polyester film 4 becoming charged with the electric charge which is electrostatically bound to surface 5.

In order to discharge the charge built-up on the polyester film 4, an impulse generator 7 is provided (in this embodiment) which is electrically coupled to a localised region 8 at one end of the polyester film 4 at a point of contact which is just above one end of the metallic tape 3. The impulse generator 7 comprises a 50 KV constant voltage power supply 7A and the coupling to the polyester film 4 is via a resistance R and a 320 nF capacitance C with a switch S connecting the R-C junction to ground. This capacitance C is in fact constructed from four 0.08 $\mu$F low inductance S type rapid discharge Maxwell capacitors. The overall inductance of the capacitor stack is approximately 10 nH.

The switch S is in the form of a spark gap arrangement constructed from two fixed ball bearings with a third electrode, also a ball bearing, capable of moving against these, thereby firing the generator 7. Upon firing the impulse generator 7, a voltage pulse is generated having a rise time of approximately 15 nS and a duration which may be in the range approximately 10 to 100 mS depending on how long the switch S remains closed. The voltage pulse is approximately −20 KV. This voltage is opposite to the polarity of the +40 KV voltage applied to the Corona discharge electrodes 6 and therefore is also oppsite to the charge bound to the surface 5 of the film 4. It is to be noted that the polarity of these two voltages can be reversed.

Light emission from the light source 1 is triggered upon the application of the voltage pulse to the polyester film 4. This pulse initiates a discharge of the surface charge to ground, commencing at the point of connection 8 of the impulse generator 7 to the polyester film 4 and spreading along the length of the polyester film 4. It is to be noted that the discharge tends to be concentrated in that region of the polyester film 4 which overlies the metallic tape 3. The rapid discharge of the polyester film 4 has associated with it the generation of light.

The frequency of light generated during the surface discharge is dependent upon the charge built-up on the surface 6 and, the properties of the gaseous medium in front of the polyester film 4, the properties of the polyester film and the properties of the electrical connections between the supply 7A and the film 4.

The intensity of light generated is dependent upon the charge, the charge density, and the magnitude and energy of the trigger pulse.

The duration of the output light is dependent upon the length of the discharge path.

In addition, the properties of the output light are dependent upon the pressure of gas present in front of the polyester film 4 (which may be contained within a housing surrounding the source). Complex interactions between the polyester film 4, the metallic tape 3, and the insulating support 2 may also affect the properties of the output light.

The source 1 may be close coupled to a target which is to be illuminated, i.e. the target may be physically close to the film 4.

Figure 4:
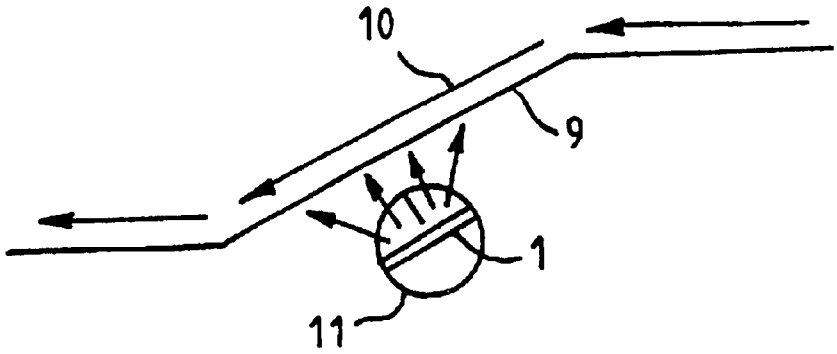
FIG. 4 illustrates an application of the light source of FIG. 1 to the UV sterilisation of a liquid.

There is shown in FIG. 4 a typical application of the light source 1 described above. An ultraviolet transparent quartz phase 9 separates the high intensity light source 1 from a continuous flow of liquid 10 to be sterilised, the light source 1 being arranged to generate ultraviolet light. The light source is contained within a tubular quartz housing 11 which may contain suitable pressurised gas.

Figure 5:
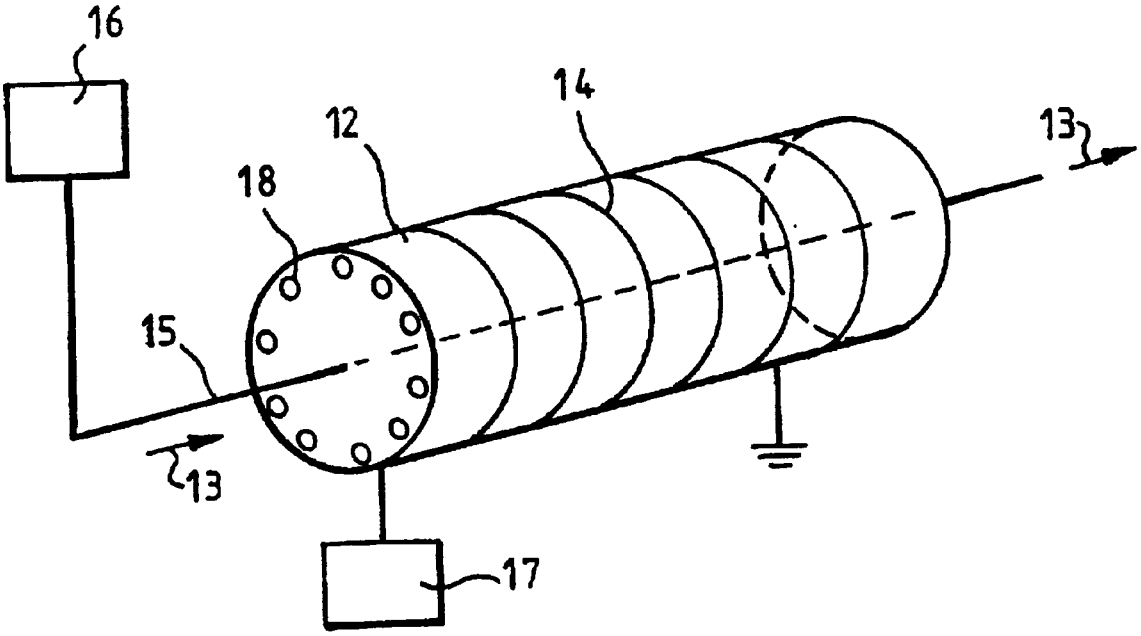
FIG. 5 illustrates a second embodiment of the present invention wherein a dielectric sheet of the light source has the form of a hollow cylinder.

There is shown in FIG. 5 a further embodiment of the present invention in which a polyester sheet 12 forms a hollow cylindrical tube through which a gas, for example air, is passed under pressure (as indicated by arrows 13). Metallic tape 14 is wrapped so as to spiral in either an open or overlapped helix around the outer surface of the cylinder 12 and is electrically connected to ground. A 'Corona' wire 15 is arranged along the axis of the cylinder and is coupled to a high voltage DC source 16. An impulse generator 17 is connected at a multiplicity of circumferentially spaced apart points 18 on one end of the cylinder 12. By applying a high voltage to the Corona wire 15, and subsequently applying a high voltage impulse, preferably of opposite polarity, simultaneously to each of the connection points 18 on the cylinder 12, multiple discharges are commenced at one end of the cylinder 12, spreading along the length of the cylinder 12 until all of the built-up charge is discharged. This process results in the generation of high intensity light which tends to be directed inwardly of the cylinder 12. Where the gas flowing through the cylinder 12 is air or oxygen, this process will result in the generation of a high concentration of ozone ($O_3$).

A modification to the embodiment of FIG. 5 involves providing a central hollow dielectric rod extending axially through the outer cylinder. The inside of the inner cylinder is coated with a conducting material whilst the outside is connected to earth at one end. A plurality of Corona wires extends axially in the region between the inner and outer cylinders. This arrangement enables the generation of light from both the inner surface of the outer cylinder and the outer surface of the inner cylinder.

It will be appreciated that, particularly with regard to the embodiment of FIG. 1, the lamp may be made of appropriately thin and flexible material such that the lamp can be arranged to conform to any appropriate shape. For example, the lamp may be arranged to have a concave shape such that the generated light can be made convergent upon a desired region. Using such an arrangement, it is also possible to steer the light in any desired direction.

In addition to the use of the described light sources for sterilising fluids and gases and for generating ozone, these light sources may be used as 'pumps' for lasers (e.g. dye lasers).

It will be appreciated by the skilled person that various modifications may be made to the above described embodiments without departing from the scope of the present invention. For example, the dielectric sheet may be circular, with the impulse generator being conducted to the centre of the sheet. If the metallic conductor coupled to the back surface of the dielectric sheet is also circular, it may be possible to initiate multiple discharges simultaneously, each extending radially outward from the centre. This type of discharge may be assisted by coupling the impulse generator to the dielectric sheet at a star shaped connector.

What is claimed is:

1. A high intensity light source comprising:

a solid dielectric sheet having a front and a back surface;

a conducting medium in contact with at least a portion of said back surface of the dielectric sheet, said conducting medium being electrically connected in use to a fixed potential;

means for establishing electric charge of a first-polarity which is electrostatically bound to said front surface of the dielectric sheet at a potential which is different from said fixed potential; and selectively-operable means coupled to said front surface of the dielectric sheet for applying a rapid potential change to at least a localized region of said front surface so as to cause the charge build-up on the dielectric sheet to form an electric discharge with the consequential emission of light.

2. The high intensity light source as claimed in claim 1 wherein the means for rapidly applying the voltage change to the dielectric sheet is any one of means for application of ground (earth) potential, or a pulse generating means.

3. The high intensity light source as claimed in claim 2, wherein the means for generating the electrical discharge rapidly applies a voltage to the front surface of the dielectric sheet which voltage is of a polarity opposite to said first polarity.

4. The high intensity light source as claimed in claim 1, wherein said conducting medium is a solid conducting medium evaporated, adhered to, or otherwise contacting said back surface of the dielectric sheet.

5. The high intensity light source as claimed in claim 4, wherein the conducting medium is any one of a metal, a semi-conductor, a photo-conductor or a conducting polymer.

6. The high intensity light source as claimed in claim 1, wherein in the conducting medium is a conducting plasma exposed to the back surface of the dielectric sheet.

7. The high intensity light source as claimed in claim 1, wherein the conducting medium and the dielectric sheet are contained within a sealed housing within which the electrical discharge is generated in a predetermined atmosphere.

8. The high intensity light course as claimed in claim 7, wherein the predetermined atmosphere comprises any one or more of the gases air, neon, xenon, argon, helium, mercury, vapor, carbon dioxide, $SF_6$.

9. The high intensity light source as claimed in claim 1, wherein the means for establishing electric charge of a first polarity is any one of a thermionic emitter, a field emitter, an electron beam generator, an ion beam generator or a unipolar Corona discharge arrangement.

10. A method of generating light pulses using a light source comprising a dielectric having a front and a back surface and a conducting medium in contact with at least a portion of said back surface of the dielectric sheet, the method comprising the steps of:

applying a fixed electrical potential to said conducting medium;

causing a build up of charge to occur on the front surface of the dielectric sheet; and subsequently applying an electrical voltage pulse to the front surface of the dielectric sheet to discharge the built-up discharge.

* * * * *